US006571438B2

(12) United States Patent
Liu

(10) Patent No.: US 6,571,438 B2
(45) Date of Patent: Jun. 3, 2003

(54) DOUBLE-BOW SHOE LACE DEVICE

(76) Inventor: Kun-Chung Liu, No. 5, Alley 9, Lane 212, San-Feng Rd., Hou-Li Hsiang, Taichung Hsien (TW)

( * ) Notice: Subject to any disclaimer, the term of this patent is extended or adjusted under 35 U.S.C. 154(b) by 0 days.

(21) Appl. No.: 09/920,946

(22) Filed: Aug. 3, 2001

(65) Prior Publication Data

US 2003/0024085 A1 Feb. 6, 2003

(51) Int. Cl.[7] ..... A43C 7/00
(52) U.S. Cl. ..... 24/712.2; 24/712.5
(58) Field of Search ..... 24/115 G, 712–712.9; 36/50.1

(56) References Cited

U.S. PATENT DOCUMENTS 743,924 A * 11/1903 Pratt
3,701,572 A * 10/1972 Velasquez
4,680,835 A * 7/1987 Horng
5,097,573 A * 3/1992 Gimeno
6,178,606 B1 * 1/2001 Glendon

FOREIGN PATENT DOCUMENTS

GB 2343701 A * 5/2000

* cited by examiner

*Primary Examiner*—James R. Brittain
(74) *Attorney, Agent, or Firm*—Foley & Lardner

(57) ABSTRACT

A double-bow shoe lace device for a shoe includes a shoe lace, a clamp member, and an assembly of two loops and a decorative knot. The shoe lace has a first lace segment that is strung on the shoe so as to form a criss-cross pattern on the eyelet tabs, and a second lace segment that includes first and second lace portions. Each of the lace portions has a lower end connected to the first lace segment so as to be anchored on a respective one of the eyelet tabs. The clamp member is sleeved slidably on at least one of the lace portions. Downward and upward movements of the clamp member along at least one of the lace portions result in tightening and loosening of the shoe. The assembly is disposed on and externally of the clamp member.

5 Claims, 9 Drawing Sheets

DOUBLE-BOW SHOE LACE DEVICE

BACKGROUND OF THE INVENTION

1. Field of the Invention

The invention relates to a shoe lace device, more particularly to a double-bow shoe lace device for a shoe.

2. Description of the Related Art

Referring to FIG. 1, a conventional shoe lace device 1 of a shoe 4 includes a shoe lace 2 having first and second lace sections 201, 202, and a clamp member 3. The first lace section 201 is strung on a shoe body 41 so as to form a criss-cross pattern on eyelet tabs 5 of the shoe body 41. The second lace section 202 is formed as a simple loop, and has lower ends 2021 connected to the first lace section 201, thereby anchoring the lower ends 2021 on the eyelet tabs 5, respectively. The clamp member 3, as shown in FIG. 2, includes an elongate casing 301, a clamping block 302, and a spring member 303. The elongate casing 301 is formed with a lateral open end 3010 for receiving the clamping block 302, a closed end 3011 opposite to the open end 3010, and a vertically extending hole unit 301' for extension of the lower ends 2021 of the second lace section 202 therethrough. The clamping block 302 is slidably received in the open end 3010 of the casing 301, and is formed with a vertically extending slot unit 3021 that corresponds to the hole unit 301' of the casing 301 for extension of the lower ends 2021 of the second lace section 202 therethrough. The spring member 303 is disposed in the casing 301, and has opposite ends that abut respectively against the clamping block 302 and the closed end 3011 of the casing 301. As such, the clamping block 302 is biased by the spring member 303 so as to misalign the slot unit 3021 from the hole unit 301' in order to clamp the second lace section 202 between the clamping block 302 and the casing 301.

To tighten the shoe 4, the clamp member 3 is forced to move downwardly along the second lace section 202, thereby bringing the lower ends 2021 of the second lace section 202 closer together.

To loosen the shoe 4, the clamping block 302 is operated to align the slot unit 3021 with the hole unit 301' against action of the spring member 303, and the clamp member 3 is then moved upwardly along the second lace section 202, thus permitting the lower ends 2021 of the second lace section 202 to move away from each.

Although the aforesaid shoe lace device 1 is easy to use, the simple loop configuration of the second lace section 202 has an unattractive appearance.

SUMMARY OF THE INVENTION

Therefore, the main object of the present invention is to provide a double-bow shoe lace device for a shoe.

Accordingly, a double-bow shoe lace device of this invention is adapted for use with a shoe having a pair of eyelet tabs. The shoe lace device comprises a shoe lace, a clamp member, and an assembly of two loops and a decorative knot between the loops. The shoe lace has first and second lace segments. The first lace segment is adapted to be strung on the shoe so as to form a criss-cross pattern on the eyelet tabs. The second lace segment includes first and second lace portions. Each of the first and second lace portions has a lower end connected to the first lace segment so as to be adapted to be anchored on a respective one of the eyelet tabs. The clamp member is sleeved slidably on at least one of the first and second lace portions. Downward movement of the clamp member along at least one of the first and second lace portions brings the lower ends of the first and second lace portions closer together for tightening the shoe. Upward movement of the clamp member along at least one of the first and second lace portions permits the lower ends of the first and second lace portions to move away from each other for loosening the shoe. The assembly is disposed on and externally of the clamp member.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
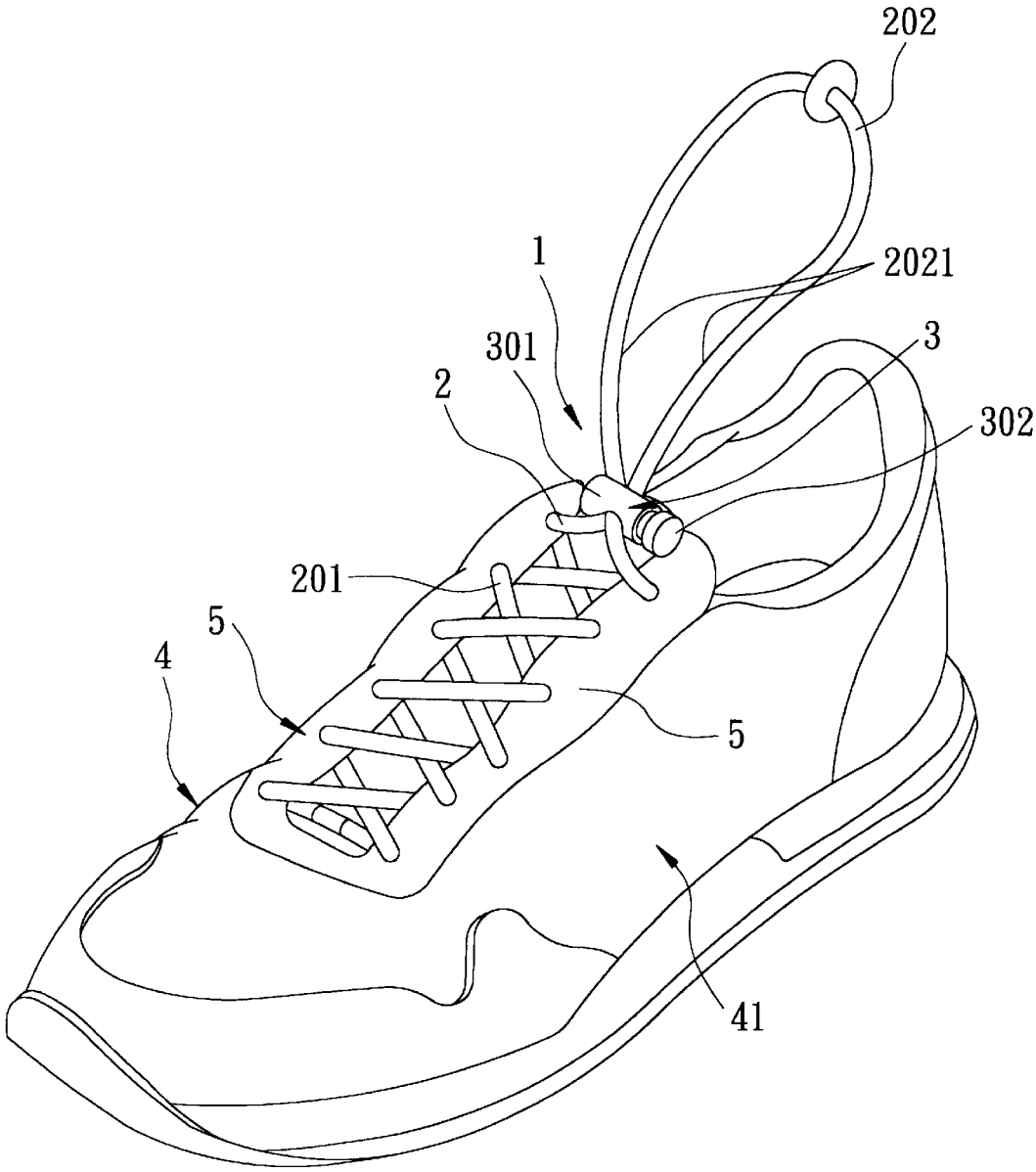
FIG. 1 PRIOR ART
FIG. 1 is a perspective view of a shoe with a conventional shoe lace device.
Figure 2:
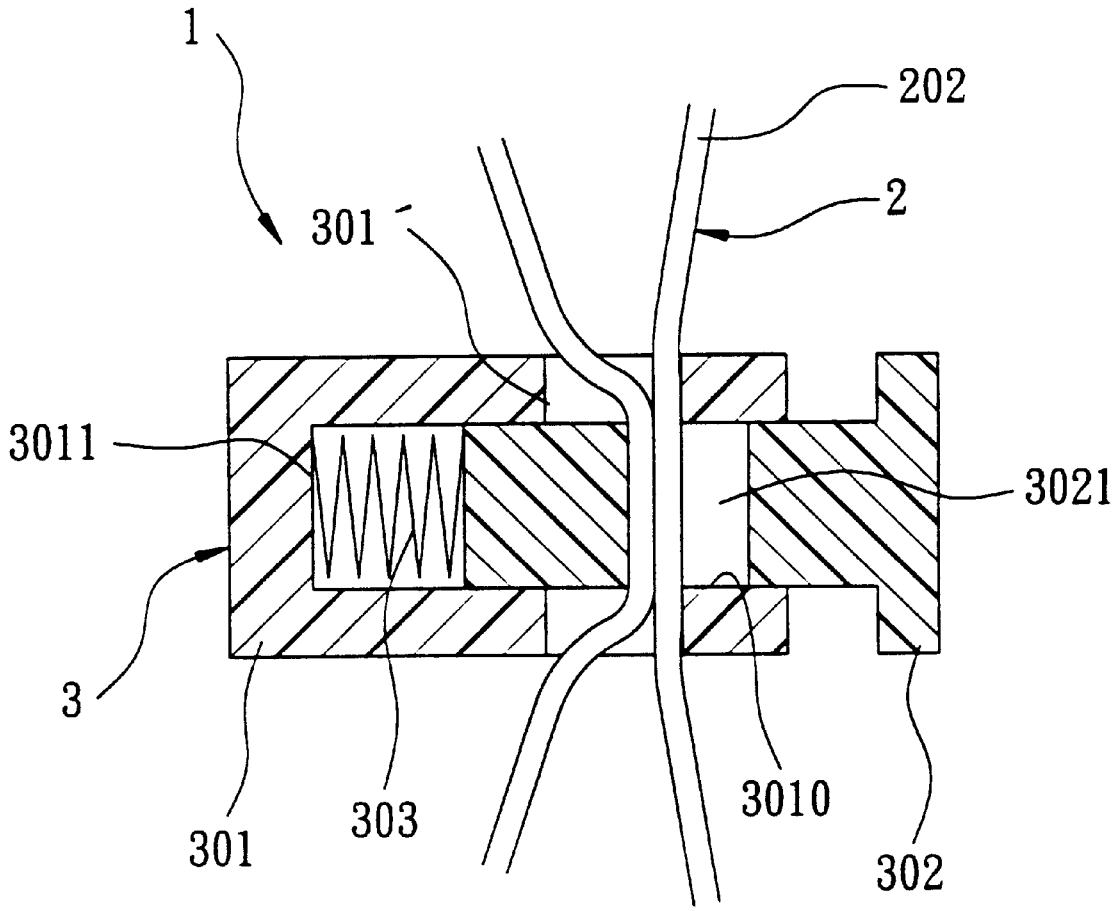
FIG. 2 PRIOR ART
FIG. 2 is a cross-sectional view of a clamp member of the conventional shoe lace device.

Before the present invention is described in greater detail, it should be noted that like elements are denoted by the same reference numerals throughout the disclosure.

Figure 3:
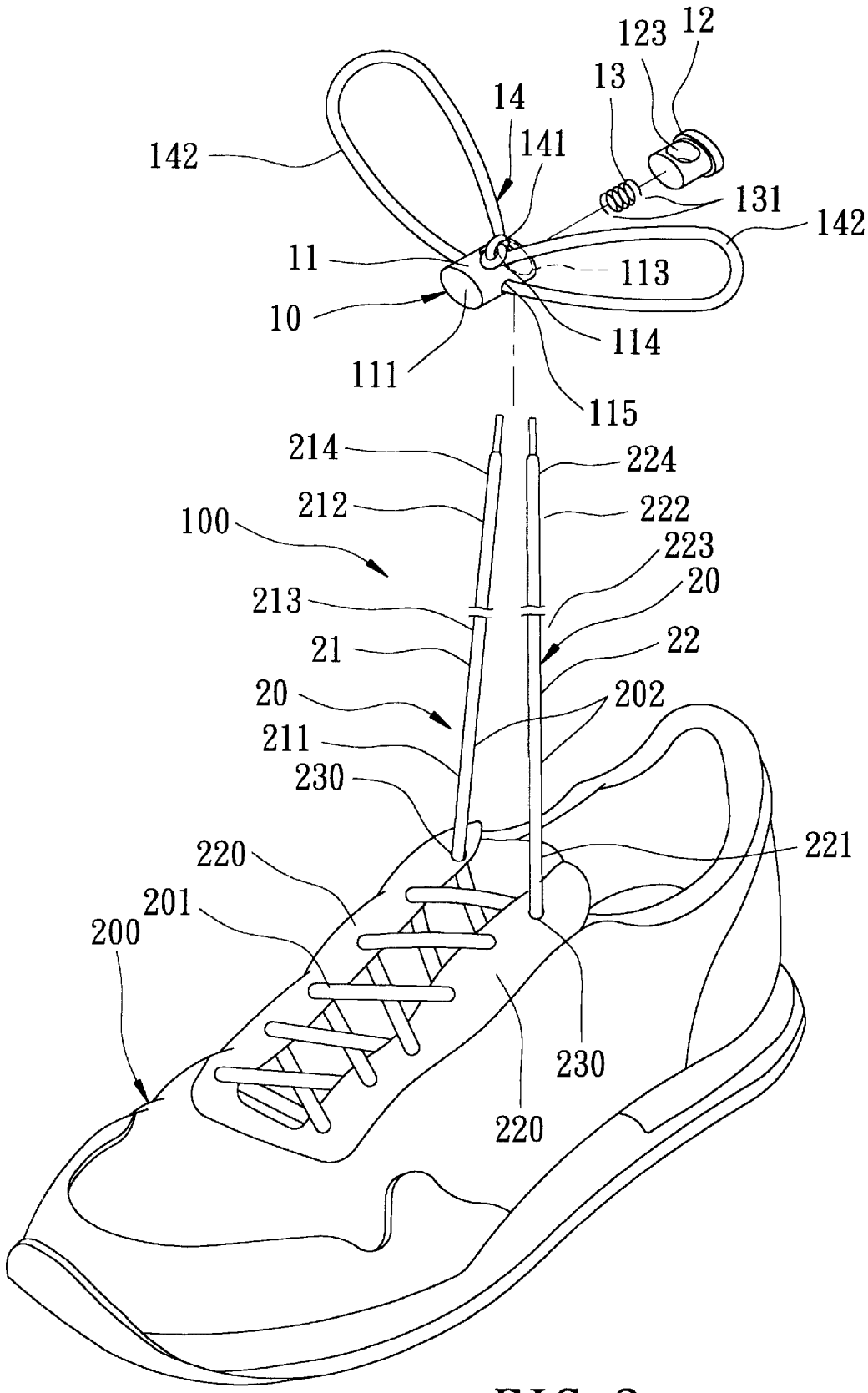
FIG. 3 is a perspective view of a shoe that incorporates the first preferred embodiment of a double-bow shoe lace device according to the present invention.
Figure 4:
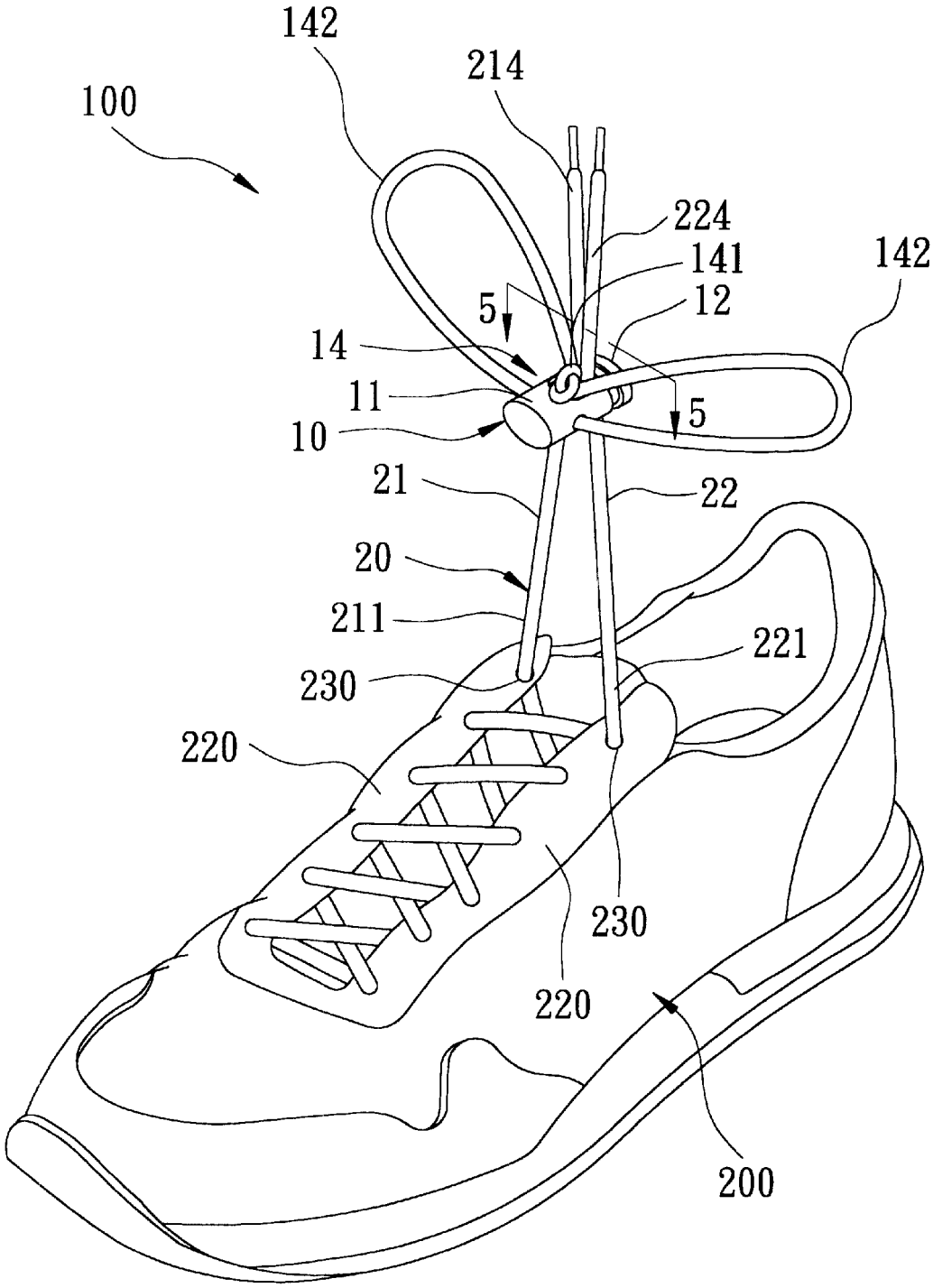
FIG. 4 is a perspective view showing how movement of a clamp member of the shoe lace device of the first preferred embodiment permits loosening of the shoe.

Referring to FIGS. 3 and 4, the first preferred embodiment of a double-bow shoe lace device 100 according to the present invention is shown to be adapted for use with a shoe 200 having a pair of eyelet tabs 220. The shoe lace device 100 comprises a shoe lace 20, a clamp member 10, and an assembly 14 of two loops 142 and a decorative knot 141 between the loops 142. The shoe lace 20 has first and second lace segments 201, 202. The first lace segment 201 is adapted to be strung on the shoe so as to form a criss-cross pattern on the eyelet tabs 220. The second lace segment 202 includes first and second lace portions 21, 22. Each of the first and second lace portions 21, 22 has a lower end 211, 221, and an upper end 212, 222. The lower ends 211, 221 of the first and second lace portions 21, 22 are connected to the first lace segment 201 so as to be adapted to be anchored respectively on the eyelets 230 of the eyelet tabs 220.

The clamp member 10 is sleeved slidably on medial sections 213, 223 of the first and second lace portions 21, 22, and includes an elongate casing 11, a clamping block 12, and a biasing member 13. The elongate casing 11 has an open lateral side 113, and a closed end portion 111 opposite to the open lateral side 113, and is formed with a first hole unit 114 that permits extension of the medial sections 213, 223 of the first and second lace portions 21, 22 therethrough, and two opposing second hole units 115 that are transverse to the first hole unit 114. The clamping block 12 is slidably received in the open lateral side 113 of the casing 11, and is formed with a groove unit 123 that corresponds to the first hole unit 114 of the casing 11 for extension of the medial sections 213, 223 of the first and second lace portions 21, 22. The biasing member 13, in the form of a coil spring, is disposed in the casing 11, has opposite ends 131 that abut respectively against the clamping block 12 and the closed end portion 111 of the casing 11, and biases the clamping block 12 toward the open lateral side 113 of the casing 11, thereby clamping the medial sections 213, 223 of the first and second lace portions 21, 22 between the clamping block 12 and the casing 11.

Figure 5:
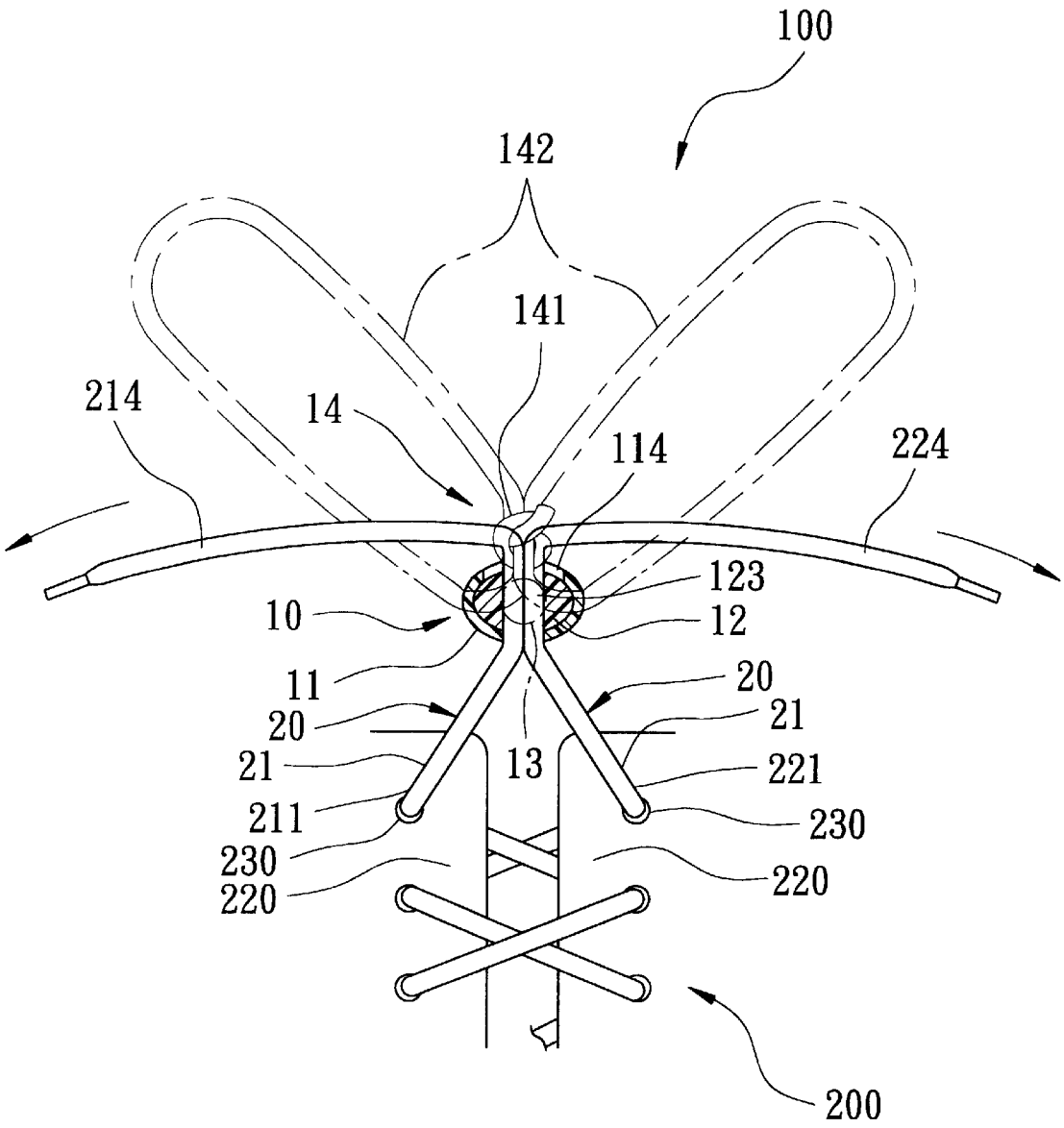
FIG. 5 is a fragmentary cross-sectional view illustrating how the shoe is tighetened by pulling apart first and second lace portions of a shoe lace.

Downward movement of the clamp member 10 along the medial sections 213, 223 of the first and second lace portions 21, 22 brings the lower ends 211, 221 of the first and second lace portions 21, 22 closer together for tightening the shoe 200 (see FIG. 5). Upward movement of the clamp member 10 along the medial sections 213, 223 of the first and second lace portions 21, 22 permits the lower ends 211, 221 of the first and second lace portions 21, 22 to move away from each other for loosening the shoe 200 (see FIG. 4).

The decorative knot 141 of the assembly 14 is disposed on and externally of the clamp member 10. Each of the loops 142 extends from the first hole unit 114 through a respective one of the second hole units 115, and out of the first hole unit 114 to connect with the knot 141. The assembly 14 is thus secured on the clamp member 10. The upper ends 212, 222 of the first and second lace portions 21, 22 form distal lace segments 214, 224 which cooperate with the assembly 14 to form a double-bow configuration.

In use, by pulling apart the distal lace segments 214, 224, the clamp member 10 will be forced to slide downwardly along the lace portions 21, 22, and the lower ends 211, 221 of the latter will be brought closer together at the same time for tightening the shoe 200, as best shown in FIG. 5. To loosen the shoe 200, the clamping block 12 is operated to compress the biasing member 13, thereby aligning the groove unit 123 with the first hole unit 114. At this time, by moving the clamp member 10 upwardly along the lace portions 21, 22, the lower sections 211, 221 of the latter can move away from each other for loosening the shoe 200, as best shown in FIG. 4.

Therefore, the shoe 200 is not only easy to wear and remove, but also has an attractive appearance in view of the double-bow configuration of the shoe lace device 100.

Figure 6:
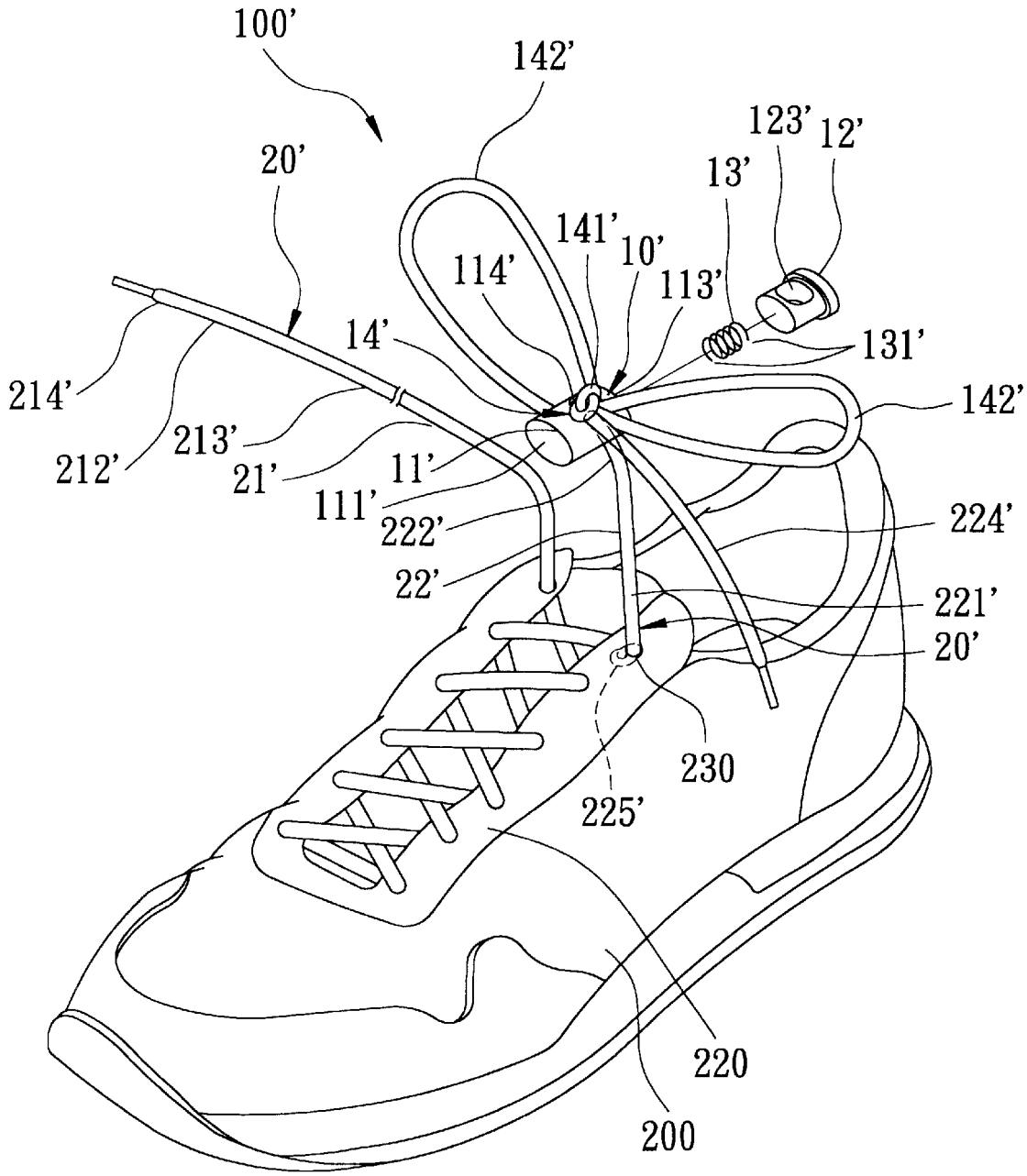
FIG. 6 is a perspective view of a shoe that incorporates the second preferred embodiment of a double-bow shoe lace device according to the present invention.
Figure 7:
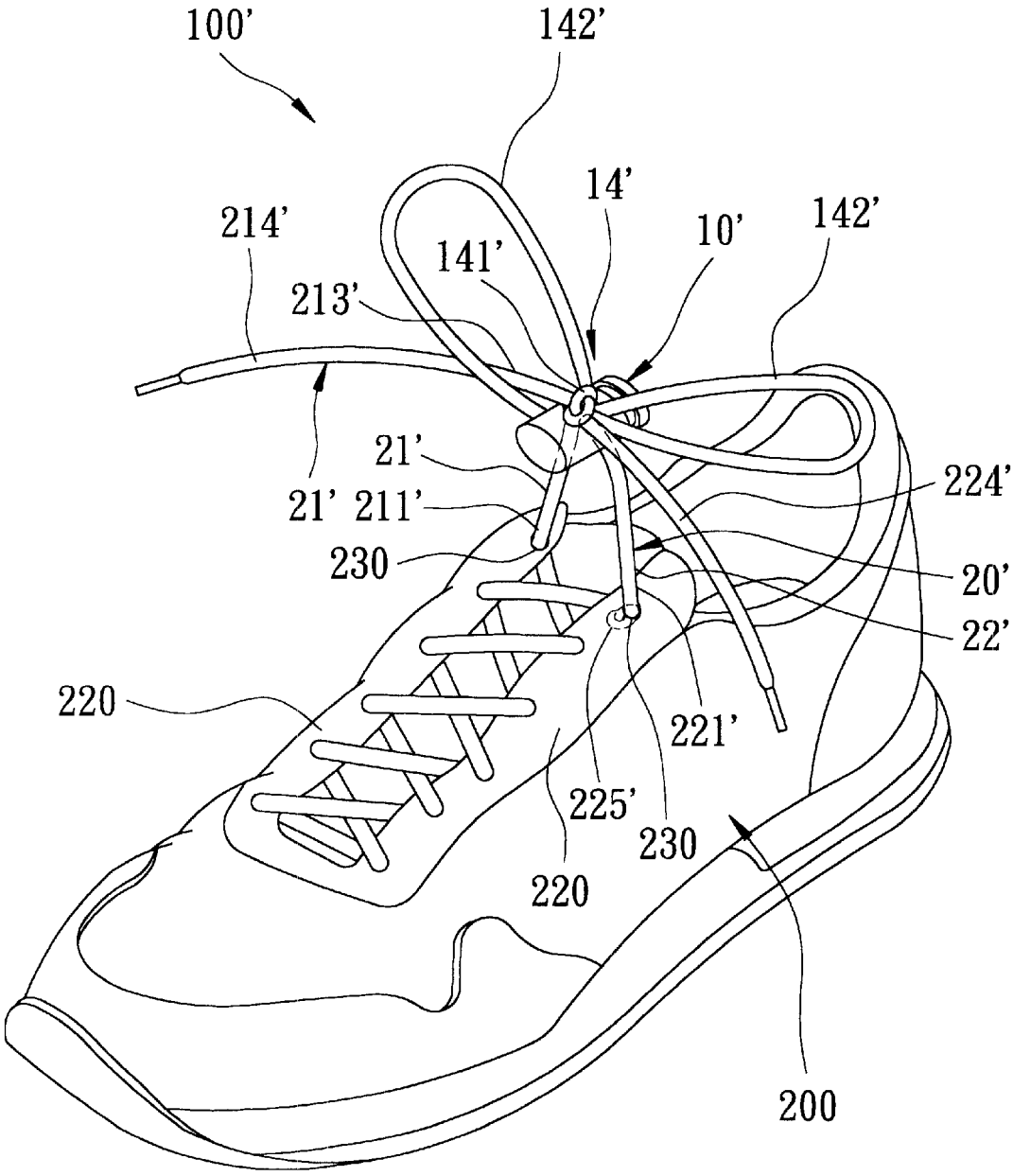
FIG. 7 is a perspective view showing the shoe lace device of the second preferred embodiment in an assembled state.

FIGS. 6 and 7 illustrate the second preferred embodiment of a double-bow shoe lace device 100 according to the present invention. Unlike the first preferred embodiment, the lower end 221' of the second lace portion 22' is formed with a knot 225' that is adapted to engage the respective one of the eyelet tabs 220. The second lace portion 22' further has the upper end 222' thereof connected to the assembly 14', thereby anchoring the same on the clamp member 10'. The first lace portion 21' has an upper end 212' that serves as a first distal lace segment 214'.

The clamp member 10' includes an elongate casing 11', a clamping block 12', and a biasing member 13'. The elongate casing 11' has an open lateral side 113', and a closed end portion 111' opposite to the open lateral side 113', and is formed with a hole unit 114' that permits extension of the medial section 213' of the first lace portion 21' therethrough. The clamping block 12' is slidably received in the open lateral side 113' of the casing 11', and is formed with a groove unit 123' that corresponds to the hole unit 114' of the casing 11' for extension of the medial section 213' of the first lace portion 21'. The biasing member 13', in the form of a coil spring, is disposed in the casing 11', has opposite ends 131' that abut respectively against the clamping block 12' and the closed end portion 111' of the casing 11', and biases the clamping block 12' toward the open lateral side 113' of the casing 11', thereby clamping the medial section 213' of the first lace portion 21' between the clamping block 12' and the casing 11'.

The knots 141', 225' of the assembly 14' and the lower end 221' of the second lace portion 22' cooperate to limit a maximum distance of the clamp member 10' from the respective one of the eyelet tabs 220. A second distal lace segment 224' is connected to the assembly 14', and cooperates with the assembly 14' and the first distal lace segment 214' to form a double-bow configuration.

Figure 8:
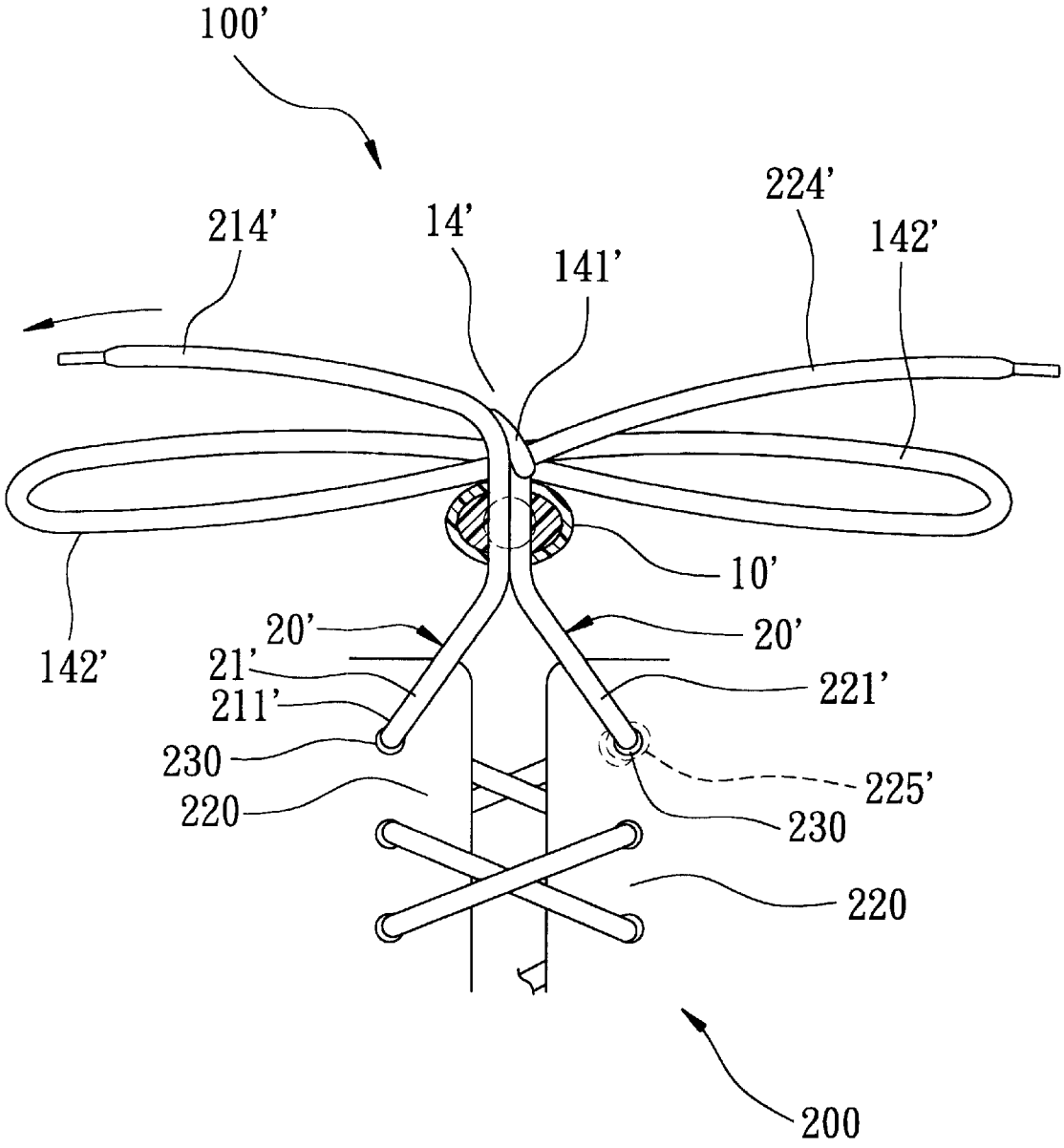
FIG. 8 is a fragmentary cross-sectional view illustrating how the shoe can be tightened by the shoe lace device of the second preferred embodiment.
Figure 9:
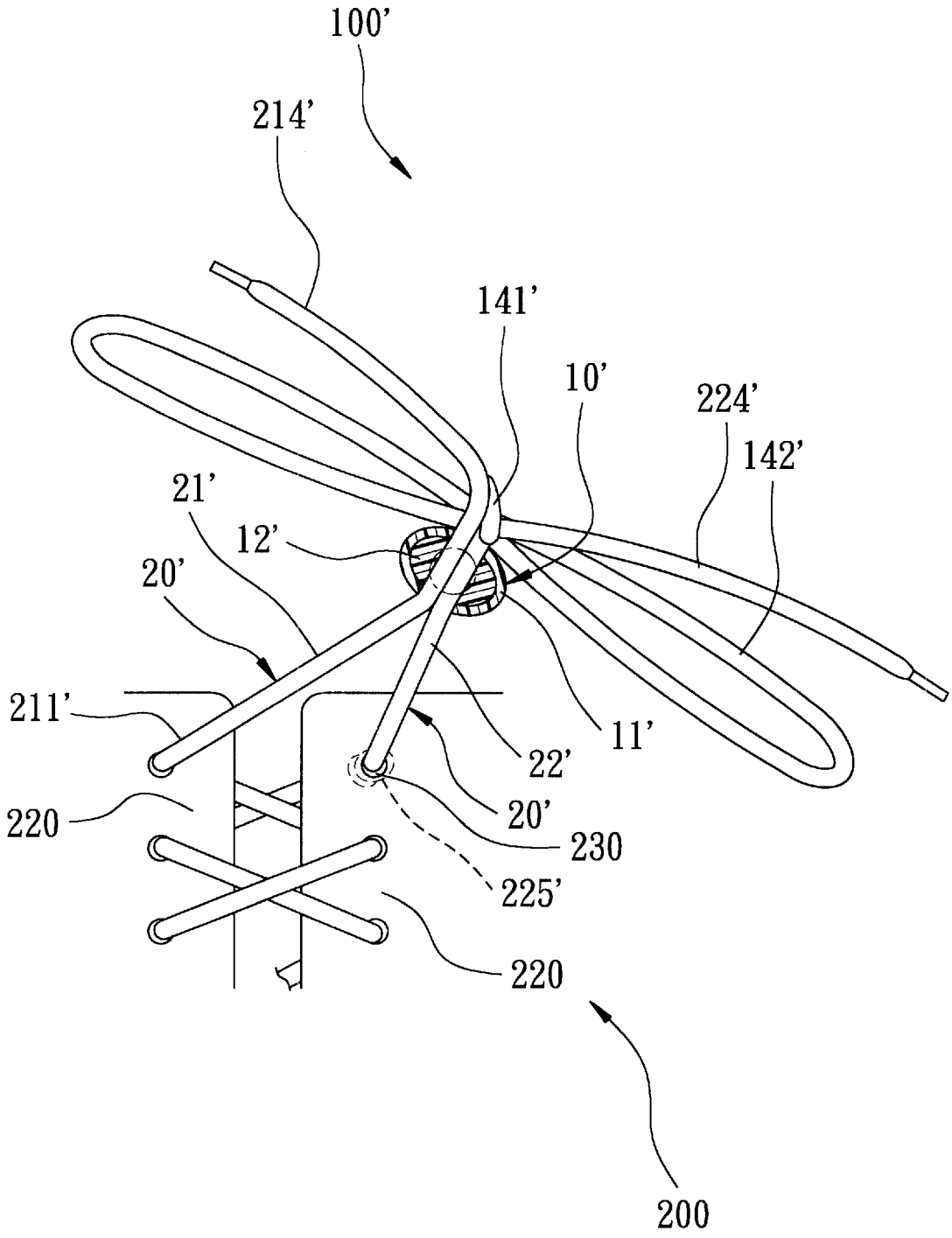
FIG. 9 is a fragmentary cross-sectional view illustrating how movement of the clamp member permits loosening of the shoe that incorporates the second preferred embodiment of the shoe lace device of this invention.

In use, when the first distal lace segment 214' is pulled away from the second distal lace segment 224' the clamp member 10' will be forced to slide downwardly along the medial section 213' of the first lace portion 21' to bring the lower ends 211', 221' of the first and second lace portions 21', 22' closer together for tightening the shoe 200 (see FIG. 8). To loosen the shoe 200, the clamping block 12' is operated to compress the biasing member 13', thereby aligning the groove unit 123' with the first hole unit 114'. At this time, the clamp member 10' can be slid upwardly along the medial section 213' of the first lace portion 21', thereby permitting the lower sections 211', 221' of the first and second lace portions 21', 22' to move away from each other for loosening the shoe 200 (see FIG. 9).

In this embodiment, the loops 142' can be tied to form two consecutive simple knots in order to ensure that the decorative knot 141' of the assembly 14' will not be loosened.

It should be noted that in the second preferred embodiment, the eyelets 230 through which the first and second lace portions 21', 22' extend can be formed to be spaced farther apart, so that the length of the second lace portion 22' can be increased, thereby allowing greater movement of the clamp member 10' to facilitate the easy wearing and removal of the shoe 200. Alternatively, a hitch member (not shown) could be used instead of the eyelet 230 to anchor removably the lower end 221' of the second lace portion 22' onto the respective eyelet tab 220 of the shoe 200 to facilitate easy wearing and removal of the shoe 200.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A double-bow shoe lace device for a shoe with a pair of eyelet tabs, said shoe lace device comprising:

a shoe lace having first and second lace segments, said first lace segment being adapted to be strung on the shoe so as to form a criss-cross pattern on the eyelet tabs, said second lace segment including first and second lace portions each of said first and second lace portions having a lower end connected to said first lace segment so as to be adapted to be anchored on a respective one of the eyelet tabs;

a clamp member sleeved slidably on at least one of said first and second lace portions, downward movement of said clamp member along said at least one of said first and second lace portions bringing said lower ends of said first and second lace portions closer together for tightening the shoe, upward movement of said clamp member along said at least one of said first and second lace portions permitting said lower ends of said first and second lace portions to move away from each other for loosening the shoe; and an assembly comprising two loops and a decorative knot between said loops, said assembly being disposed on and externally of said clamp member, wherein said lower end of said second lace portion is formed with a knot that is adapted to engage the respective one of the eyelet tabs.

2. A double-bow shoe lace device for a shoe with a pair of eyelet tabs, said shoe lace device comprising:

a shoe lace having first and second lace segments, said first lace segment being adapted to be strung on the shoe so as to form a criss-cross pattern on the eyelet tabs, said second lace segment including first and second lace portions, each of said first and second lace portions having a lower end connected to said first lace segment so as to be adapted to be anchored on a respective one of the eyelet tabs, and an upper end, said upper end of said first lace portion serving as a first distal lace segment;

a clamp member sleeved slidably on at least one of said first and second lace portions, said upper end of said second lace portion being anchored on said clamp member, downward movement of said clamp member along said at least one of said first and second lace portions bringing said lower ends of said first and second lace portions closer together for tightening the shoe, upward movement of said clamp member along said at least one of said first and second lace portions permitting said lower ends of said first and second lace portions to move away from each other for loosening the shoe; and an assembly comprising two loops, a decorative knot between said loops, and a second distal lace segment connected to said decorative knot, said assembly being disposed on and externally of said clamp member, said assembly cooperating with said first distal lace segment to form a double-bow configuration.

3. The double-bow shoe lace device of claim 2, wherein said lower end of said second lace portion is formed with a knot that is adapted to engage the respective one of the eyelet tabs.

4. The double-bow shoe lace device of claim 2, wherein said upper end of said second lace portion is connected to said assembly.

5. The double-bow shoe lace device of claim 2, wherein said clamp member comprises:

an elongate casing having an open lateral side and formed with a hole unit that permits extension of said at least one of said first and second lace portions therethrough;

a clamping block slidably received in said casing and formed with a groove unit for extension of said at least one of said first and second lace portions; and a biasing member disposed in said casing and biasing said clamping block toward said open lateral side of said casing, thereby clamping said at least one of said first and second lace portions between said clamping block and said casing.

* * * * *